US009893409B2

(12) United States Patent
Chueh

(10) Patent No.: US 9,893,409 B2
(45) Date of Patent: Feb. 13, 2018

(54) BRANCH-LINE COUPLER

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Yu-Chih Chueh, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 33 days.

(21) Appl. No.: 15/200,151

(22) Filed: Jul. 1, 2016

(65) Prior Publication Data

US 2018/0006353 A1 Jan. 4, 2018

(51) Int. Cl.
*H01P 5/12* (2006.01)
*H01P 5/22* (2006.01)

(52) U.S. Cl.
CPC ..... *H01P 5/227* (2013.01)

(58) Field of Classification Search
CPC ..... H01P 5/12; H01P 5/19; H01P 5/227
USPC ..... 333/109–112, 116–120
See application file for complete search history.

(56) References Cited

U.S. PATENT DOCUMENTS 6,727,767 B2 * 4/2004 Takada ..... H03B 5/326 310/313 R
6,753,745 B2 * 6/2004 Killen ..... H01P 5/227 333/117
8,044,748 B2 * 10/2011 Valenti ..... H04N 5/38 333/109

* cited by examiner

*Primary Examiner* — Dean Takaoka
(74) *Attorney, Agent, or Firm* — ScienBiziP, P.C.

(57) ABSTRACT

A branch-line coupler suitable for use in mobile devices includes a first, second, third, and fourth ports, respectively acting as input, transmitted, coupled, and isolated port. A first, second, third, and fourth connection parts are connected to the ports and transmission lines. First and second bent transmission lines are electrically connected between first and second ports. Third and fourth bent transmission lines are electrically connected between third and fourth ports. A first long strip transmission line is electrically connected between the first port and the fourth port. A second long strip transmission line is electrically connected between the second port and the third port. The branch-line coupler occupies a small area and has high performance.

10 Claims, 7 Drawing Sheets

BRANCH-LINE COUPLER

FIELD

The present disclosure generally relates to couplers, and more particularly to branch-line couplers.

BACKGROUND

It is well-known that directional couplers are usually used to solve the problems relating to power splitting in many microwave circuits. With the development of mobile communication technology and satellite communication technology, for convenient carrying and moving, the miniaturization of the communication devices becomes more and more important.

Branch-line couplers are widely applied to microwave integrated circuits and monolithic integrated circuits. The conventional branch-line coupler, such as the 3 dB branch-line coupler is constituted of four quarter-wavelength lines. FIG. 1 shows the circuit configuration of a conventional 3 dB branch-line coupler of prior art. In FIG. 1, the length and width of the branch-line coupler respectively are 7.4 mm and 9.14 mm. However, the branch-line coupler occupies a large area of the printed circuit board (PCB). Therefore, a minimized and high performance 3 dB branch-line coupler would be preferable.

SUMMARY

A minimized branch-line coupler to match the demands of communication technology is provided.

The present disclosure provides a branch-line coupler, which includes a first port, a second port, a third port, and a fourth port, respectively an input port, a transmitted port, a coupled port, and an isolated port. A first connection part, a second connection part, a third connection part, and a fourth connection part are connected to these ports, and transmission line. A first bent transmission line and a second bent transmission line are electrically connected between the first port and the second port respectively. A third bent transmission line and a fourth bent transmission line are electrically connected between the third port and the fourth port. A first long strip transmission line is electrically connected between the first port and the fourth port. A second long strip transmission line is electrically connected between the second port and the third port.

The branch-line coupler of the disclosure occupies a small area and has high performance, which can be suitably applied to the mobile communication product.

BRIEF DESCRIPTION OF THE DRAWINGS

Implementations of the present technology will now be described, by way of example only, with reference to the attached figures, wherein.

DETAILED DESCRIPTION

Figure 1:
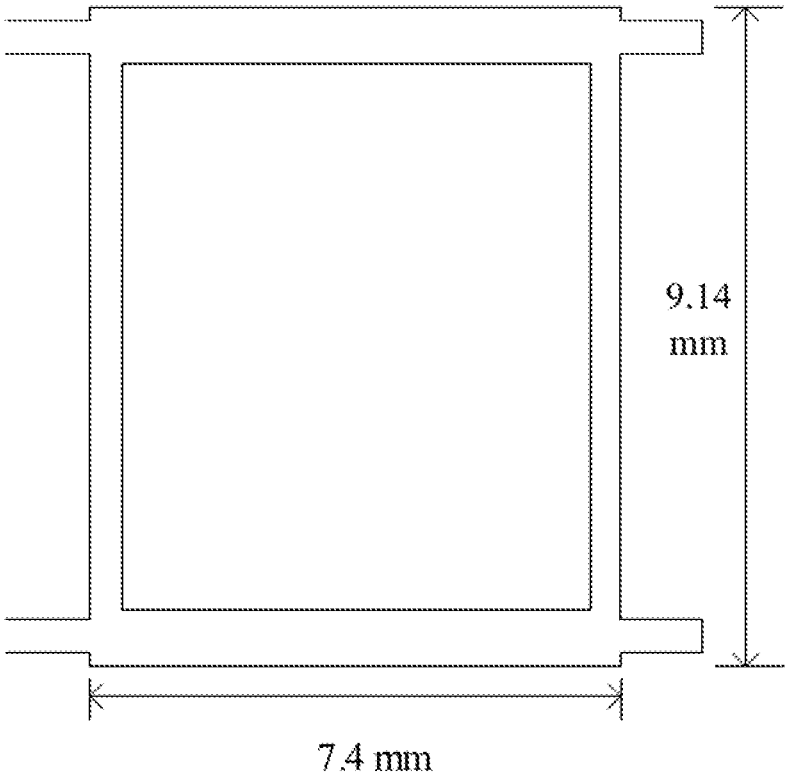
FIG. 1 (PRIOR ART)
FIG. 1 is a circuit configuration schematic diagram of a branch-line coupler according to the prior art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to". it specifically indicates open-ended inclusion or membership in the so-described combination, group, series and the like.

Figure 2:
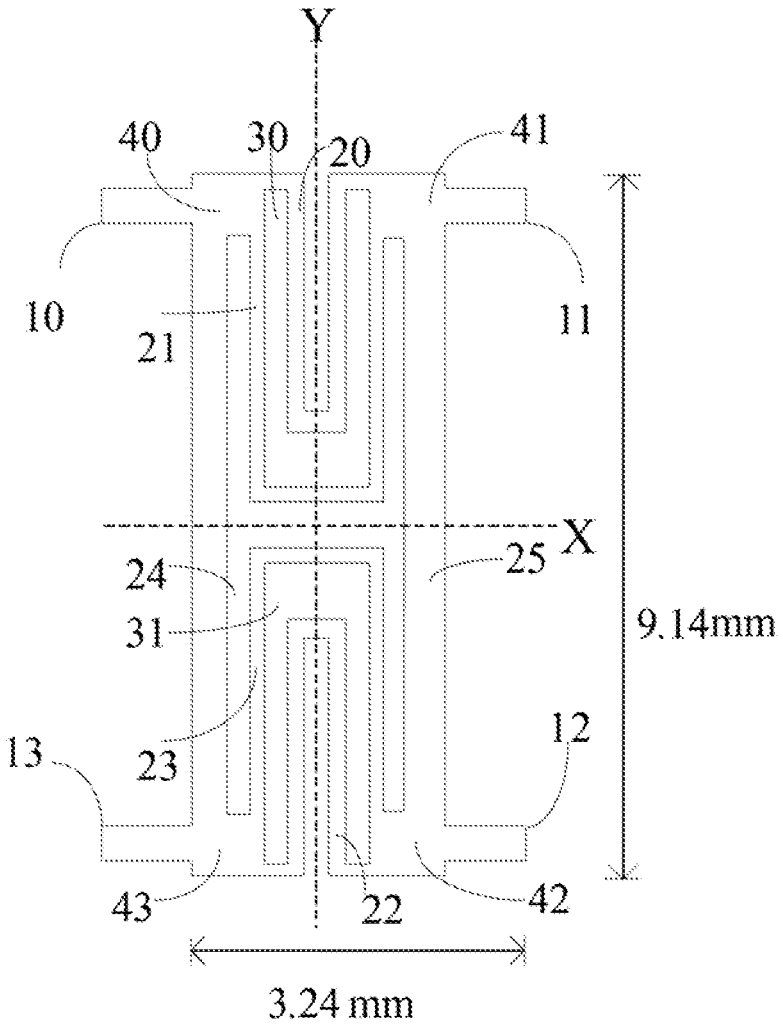
FIG. 2 is a circuit configuration schematic diagram of a branch-line coupler according to an embodiment of the disclosure.

FIG. 2 shows a branch-line coupler according to an embodiment of the disclosure. The branch-line coupler is symmetrical about X axis and Y axis, in other words, it is symmetrical about the center line of the two sides of the branch-line coupler. The branch-line coupler includes a first port 10, a second port 11, a third port 12, a fourth port 13, a first bent transmission line 20, a second bent transmission line 21, a third bent transmission line 22, and a fourth bent transmission line 23. The branch-line coupler also includes a first long strip transmission line 24 and second long strip transmission line 25, a first gap 30 and a second gap 31, a first connection part 40, a second connection part 41, a third connection part 42, and a fourth connection part 43.

The first port 10, the second port 11, the third port 12, and the fourth port 13 can be 50 ohms transmission lines. It should be understood that transmission line size is not to be considered as limiting the present disclosure, the transmission line with different impedances can be selected according to meet the demands of port matching. The first port 10 can be an input port, configured to input electromagnetic wave signal. The second port 11 can be a transmitted port, configured to output the electromagnetic wave signal from the input port. The third port 12 can be a coupled port, configured to output coupled electromagnetic wave signal. The fourth port 13 can be an isolated port. The aforesaid port configuration is not to be considered as limiting the present disclosure, the port configuration can be defined freely because the present branch-line coupler is symmetrical about the center lines of the two sides of the branch-line coupler.

The size of the first bent transmission line 20, the second bent transmission line 21, the third bent transmission line 22, and the fourth bent transmission line 23 can be 70.7 ohms transmission lines, the first bent transmission line 20 is connected in parallel to the second bent transmission line 21 and they are set in parallel, also they are respectively electrically connected to the first port 10 and the second port 11 through the first connection part 40 and the second connection part 41. In FIG. 2, the first bent transmission line 20 is U shaped, as is the second bent transmission line 21. Horizontal edge length of the first bent transmission line 20 is shorter than horizontal edge length of the second bent transmission line 21. In one embodiment, the shape of the first bent transmission line 20 is half-surrounded by the shape of the second bent transmission line 21, the head and tail of the first bent transmission line 20 and the second bent transmission line 21 are respectively and electrically connected through the first connection part 40 and the second connection part 41. The first gap 30 width between the first bent transmission line 20 and the second bent transmission line 21 is set longer than 70.7 ohms transmission line width, in other words, the first gap 30 is longer than first bent transmission line 20 width and the second bent transmission line 21 width. The third bent transmission line 22 is connected in parallel to the fourth bent transmission line 23 and they are set in parallel, also they are respectively and electrically connected to the third port 12 and the fourth port 13 through the third connection part 42 and the fourth connection part 43. In FIG. 2, the shape constituted by the third bent transmission line 22 and the fourth bent transmission line 23 is the symmetrical shape of the shape constituted by the first bent transmission line 20 and the second bent transmission line 21. They are symmetrical about the X axis, also second gap 31 width between the third bent transmission line 22 and the fourth bent transmission line 23 is set longer than the 70.7 ohms transmission line width. It should be understood that the impedances of the transmission lines herein is not to limit the present disclosure, they can be selected freely to meet requirements. Also, the shape constituted by the first bent transmission line 20 and the second bent transmission line 21 and the shape constituted by the third bent transmission line 22 and the fourth bent transmission line 23 are not to be considered as limiting the present disclosure.

The first long strip transmission line 24 and the second long strip transmission line 25 can be 50 ohms transmission line, the first long strip transmission line 24 is electrically connected to the first connection part 40 and the fourth connection part 43. The second long strip transmission line 25 is electrically connected to the second connection part 41 and the third connection part 42, and the second long strip transmission line 25 and the first long strip transmission line 24 are respectively connected to each port and other transmission line through a connection part.

The first connection part 40, the second connection part 41, the third connection part 42, and the fourth connection part 43 can be transmission lines. The first connection part 40 is electrically connected to the first port 10, the first bent transmission line 20, the second bent transmission line 21, and the first long strip transmission line 24. The second connection part 41 is electrically connected to the second port 11, the first bent transmission line 20, the second bent transmission line 21, and the second long strip transmission line 25. The third connection part 42 is electrically connected to the third port 12, the third bent transmission line 22, the fourth bent transmission line 23, and the second long strip transmission line 25. The fourth connection part 43 is electrically connected to the fourth port 13, the third bent transmission line 22, the fourth bent transmission line 23, and the first long strip transmission line 24. The aforesaid transmission lines can be microstrip lines or other transmission lines.

As shown in FIG. 2, the length and width of the disclosed branch-line coupler respectively are 3.24 mm and 9.13 mm. It should be understood that the size of the branch-line coupler is decided by the required frequency of branch-line coupler, it is not to limit the present disclosure, and any size of the branch-line coupler can be chosen to adapt the requirement of the frequency.

Figure 3:
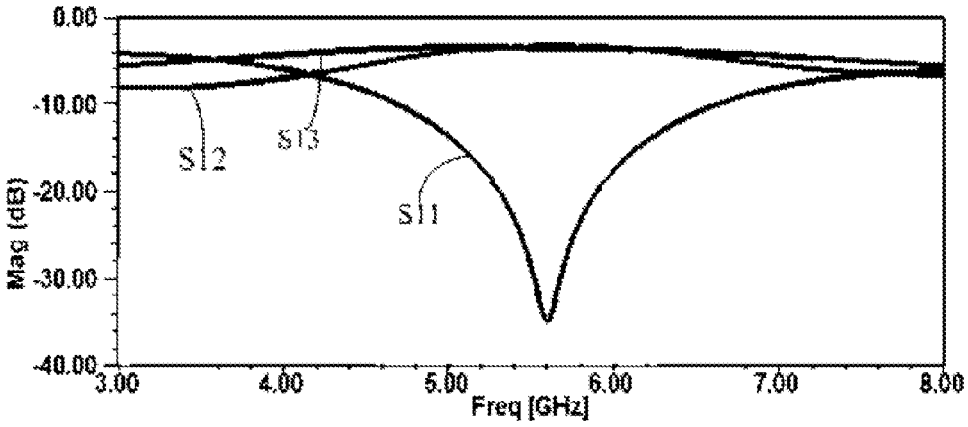
FIG. 3 is a s-parameter simulation diagram of a branch-line coupler according to an embodiment of the disclosure, wherein Freq denotes frequency and Mag denotes magnitude.

FIG. 3 shows an s-parameter simulation diagram of a branch-line coupler according to an embodiment of the disclosure. In FIG. 3, the frequency band of the branch-line coupler corresponding to the parameter of S11 below −10 dB is between 4.6 Ghz and 6.6 Ghz, the center frequency is 5.6 Ghz. The S12 and S13 parameters have 3 dB power loss at that frequency band. The parameters S22, S33, and S44 of the second port 11, the third port 12, and the fourth port 13 are approximate to parameter S11 of the first port 10. For simplicity, diagrams for S22, S33, and S44 are not given.

Figure 4:
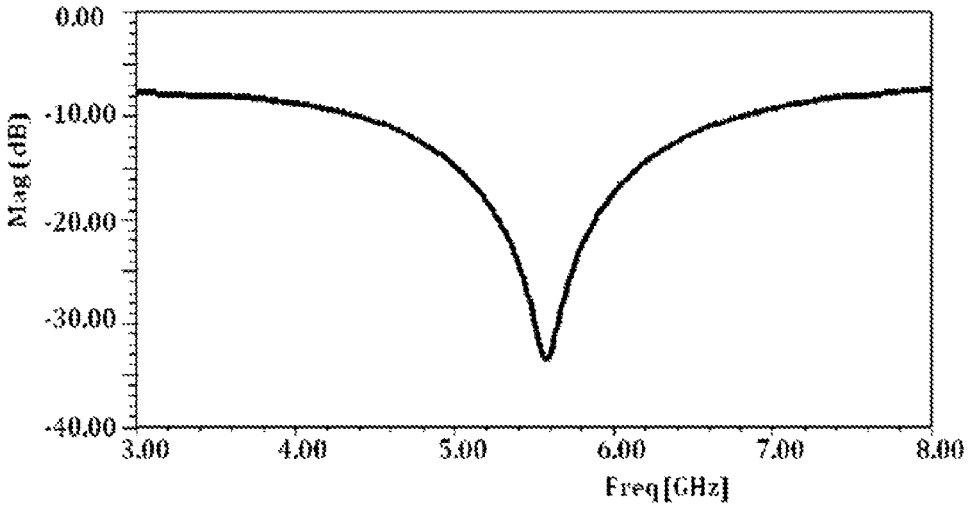
FIG. 4 is a s-parameter simulation diagram of degree of isolation between two output ports of a branch-line coupler, according to an embodiment of the disclosure.

FIG. 4 shows an s-parameter simulation diagram of isolation degree of two output ports of a branch-line coupler according to an embodiment of the disclosure. As FIG. 4 shows, the two outputs of the branch-line coupler have a high degree of isolation at the frequency band of 4.6 Ghz-6.8 Ghz.

Figure 5:
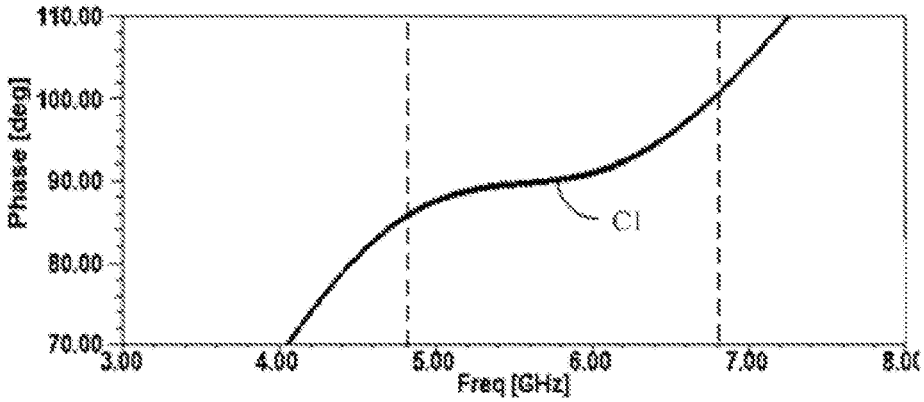
FIG. 5 is an output phase difference diagram of two output ports of a branch-line coupler, according to an embodiment of the disclosure.

FIG. 5 shows an output phase difference diagram of two output ports of a branch-line coupler according to an embodiment of the disclosure. In FIG. 5, the second port 11 and the third port 12 have a small phase difference at the frequency band of 4.6 Ghz to 6.8 Ghz. Specifically, the output phase difference of the second port 11 and the third port 12 is less than 20°.

Figure 6:
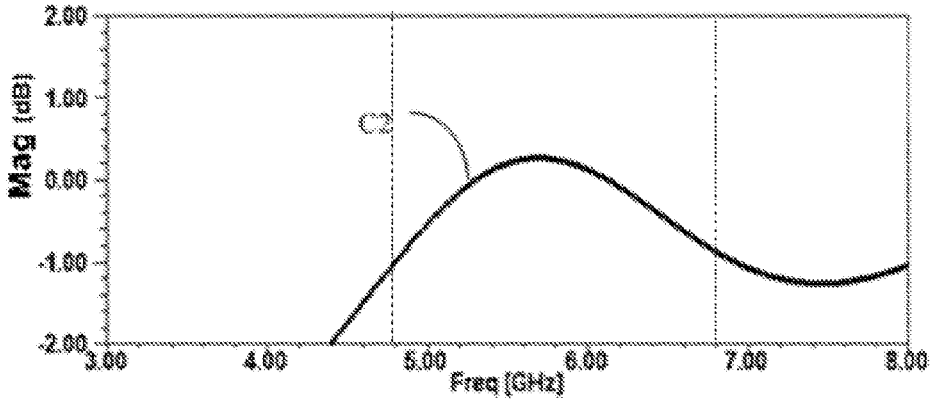
FIG. 6 is an output magnitude difference diagram of two output ports of a branch-line coupler, according to an embodiment of the disclosure.

FIG. 6 shows a magnitude difference in output of two output ports of a branch-line coupler according to an embodiment of the disclosure. In FIG. 6, the second port 11 and the third port 12 of the branch-line coupler have a small magnitude output difference at the frequency band 4.8 Ghz-6.8 Ghz. Specifically, the magnitude output difference between the second port 11 and the third port 12 is less than 2 dB.

Figure 7:
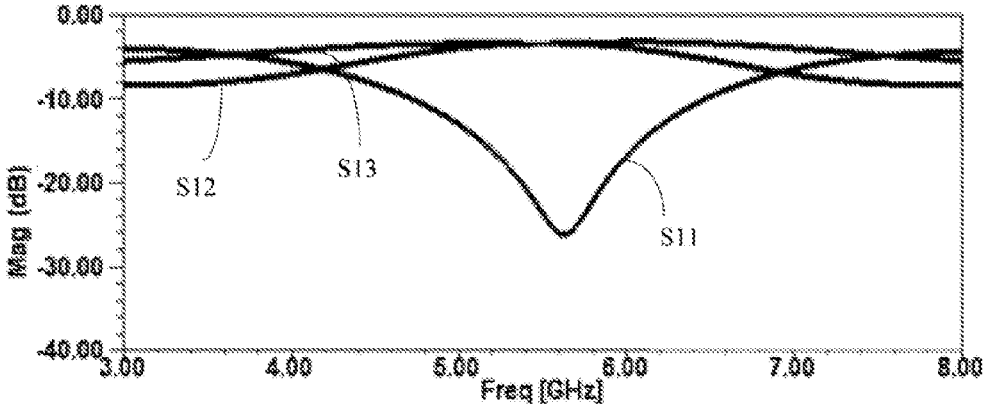
FIG. 7 is a s-parameter simulation diagram of a conventional branch-line coupler.

FIG. 7 shows an s-parameter simulation diagram of a conventional branch-line coupler. As FIG. 7 shows, the frequency band corresponding to the parameter S11 of the conventional branch-line coupler below −10 dB is 4.6 Ghz-6.6 Ghz. The center frequency is 5.6 Ghz, and the S12, S13 parameters have 3 dB power loss at the frequency band of 4.6 Ghz to 6.6 Ghz.

Comparing FIG. 3 with FIG. 7, the branch line coupler has a performance as good as that of a conventional branch-line coupler.

The branch-line coupler formed by bent transmission lines decreases the size by 56% as compared with the conventional branch-line coupler. In addition, the coupler has good performance at the frequency band 4.6 Ghz to 6.6

Ghz, and the S11 parameter is below −10 dB at the aforesaid frequency band. The magnitude of output and output phase of the two output ports have little difference and the two ports of the branch-line coupler have a high degree of isolation. The present coupler not only overcomes the disadvantage of occupying a large PCB area, but also has good performance, and is very suitable in mobile communication products.

The foregoing description, for purposes of explanation, is with reference to specific embodiments. However, the illustrated embodiments are not intended to be exhaustive or to limit the disclosure to the precise forms disclosed. Many modifications and variations are possible in view of the above teachings. The various modifications which are possible within the principles of the disclosure will therefore be protected within the scope of the claims.

What is claimed is:

1. A branch-line coupler, comprising:

an input port, a transmitted port, a coupled port, and an isolated port;

a first connection part, a second connection part, a third connection part and a fourth connection part, successively electrically connected to the input port, the transmitted port, the coupled port and the isolated port;

a first bent transmission line and a second bent transmission line, electrically connected between the input port and the transmitted port;

a third bent transmission line and a fourth bent transmission line, electrically connected between the coupled port and the isolated port;

a first long strip transmission line, electrically connected between the input port and the isolated port; and a second long strip transmission line, electrically connected between the transmitted port and the coupled port.

2. The branch-line coupler of claim 1, wherein the first bent transmission line is electrically connected in parallel to the second bent transmission line and they are set in parallel; and the first bent transmission line is U shaped, so does the second bent transmission line; and horizontal edge length of the first bent transmission line is shorter than horizontal edge length of the second bent transmission line; and shape of the first bent transmission line is half-surrounded by shape of the second bent transmission line.

3. The branch-line coupler of claim 2, wherein gap width between the first bent transmission line and the second bent transmission line is set longer than a first bent transmission line width and a second bent transmission line width.

4. The branch-line coupler of claim 1, wherein the third bent transmission line is electrically connected in parallel to the fourth bent transmission line and they are set in parallel; and a second shape constituted by the third bent transmission line and the fourth bent transmission line is a symmetrical shape of a first shape constituted by the first bent transmission line and the second bent transmission line.

5. The branch-line coupler of claim 4, wherein gap width between the third bent transmission line and the fourth bent transmission line is set longer than a third bent transmission line width and a fourth bent transmission line width.

6. The branch-line coupler of claim 1, wherein the first bent transmission line, the second bent transmission line, the third bent transmission line, and the fourth bent transmission line are 70.7 ohms transmission line.

7. The branch-line coupler of claim 1, wherein the first long strip transmission line and the second long strip transmission line are 50 ohms transmission lines.

8. The branch-line coupler of claim 1, wherein:

the first connection part is electrically connected to the input port, the first bent transmission line, the second bent transmission line, and the first long strip transmission line;

the second connection part is electrically connected to the transmitted port, the first bent transmission line, the second bent transmission line, and the second long strip transmission line;

the third connection part is electrically connected to the coupled port, the third bent transmission line, the fourth bent transmission line, and the second long strip transmission line; and the fourth connection part is electrically connected to the isolated port, the third bent transmission line, the fourth bent transmission line, and the first long strip transmission line.

9. The branch-line coupler of claim 1, wherein the first connection part, the second connection part, the third connection part, and the fourth connection part are transmission lines.

10. The branch-line coupler of claim 1, wherein the branch-line coupler is symmetrical about center line of two edges of the branch-line coupler.

* * * * *